United States Patent [19]

Hines

[11] Patent Number: 4,628,859

[45] Date of Patent: Dec. 16, 1986

[54] APPARATUS AND WORKPIECE FIXTURE FOR ELECTROSTATIC SPRAY COATING

[76] Inventor: Andrew D. Hines, 46 Fordham Trail, Hopatcong, N.J. 07843

[21] Appl. No.: 723,089

[22] Filed: Apr. 15, 1985

[51] Int. Cl.[4] ..... B05B 5/08

[52] U.S. Cl. ..... 118/630; 118/500; 204/297 W

[58] Field of Search ..... 118/630, 635, 500, 503; 204/297 W; 211/113, 119; 248/303

[56] References Cited

U.S. PATENT DOCUMENTS

| | | | |
|---|---|---|---|
| 1,354,930 | 10/1920 | Williams | 118/500 |
| 2,462,431 | 2/1949 | Schneider | 204/297 W |
| 2,655,128 | 10/1953 | Ransburg | 118/635 |
| 2,730,988 | 1/1956 | Starkey | 118/500 X |
| 3,000,806 | 9/1961 | Marotta et al. | 204/297 |
| 3,607,707 | 9/1971 | Chenevier | 204/297 |
| 3,642,127 | 2/1972 | Voorhies | 118/500 X |
| 3,762,951 | 10/1973 | Hetznecker | 118/500 X |
| 3,900,000 | 8/1975 | Gallen | 118/630 |
| 4,069,790 | 1/1978 | Witte | 118/500 X |
| 4,088,254 | 5/1978 | Hooper | 118/500 X |
| 4,097,359 | 6/1978 | Davitz | 118/500 X |
| 4,217,853 | 8/1980 | Davitz | 118/500 |
| 4,243,146 | 1/1981 | Davitz | 204/297 W |
| 4,289,090 | 9/1981 | Bagby et al. | 118/500 X |
| 4,355,974 | 10/1982 | Lee | 118/500 X |
| 4,450,954 | 5/1984 | O'Connell | 198/173 |

FOREIGN PATENT DOCUMENTS

| | | | |
|---|---|---|---|
| 614050 | 12/1948 | United Kingdom | 204/297 W |

*Primary Examiner*—John P. McIntosh

*Attorney, Agent, or Firm*—Lerner, David, Littenberg, Krumholz & Mentlik

[57] ABSTRACT

An apparatus including a workpiece fixture which insures electrical continuity with removable article engaging hooks is disclosed. The hooks have resilient U-shaped ends which frictionally engage contacting surfaces defined by pairs of opposed notches on a supporting member. The removal and reinsertion of the hooks removes foreign material from the contacting surfaces to insure electrical continuity during an electrostatic spray coating operation.

17 Claims, 10 Drawing Figures

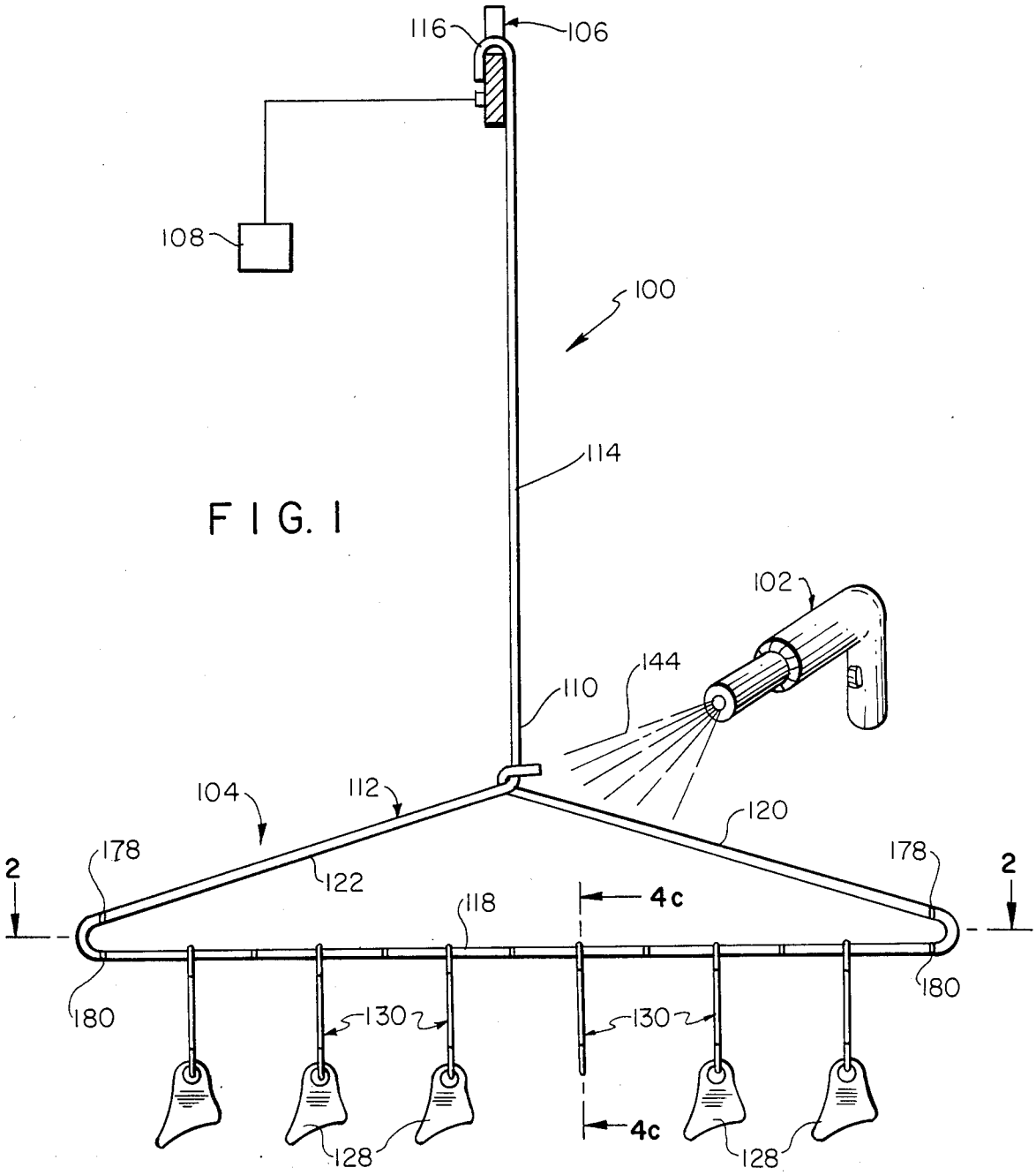
FIG. 1
FIG. 2
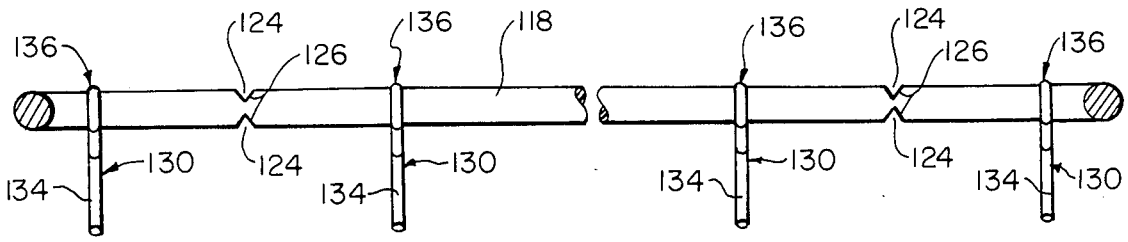

APPARATUS AND WORKPIECE FIXTURE FOR ELECTROSTATIC SPRAY COATING

BACKGROUND OF THE INVENTION

The present invention relates in general to an apparatus for electrostatic spray coating of liquid or dry charged particles onto workpieces at a coating station such as a paint spray booth and, more particularly, to a workpiece fixture in the nature of hangers or tiered support members which are fabricated of metal and used for supporting plural articles as they are conveyed through a finishing system.

Workpiece fixtures are frequently used to support a plurality of articles while they are being surface treated. These fixtures are usually provided with several vertically stacked, horizontal rows of protruding article-engaging hooks upon which workers hang articles to be finished. Ordinarily, each hook is constructed of a piece of wire having its article-engaging end bent into a hook shape. However, it should be understood that the term "hook" as utilized herein includes the great variety of configurations which may be devised for engaging parts to be finished. The workpiece fixture and its suspended articles travel through the finishing system which can have a series of stations at which they may be sequentially treated with one or more of the steps of cleaning, rinsing, surface preparation such as undercoating, electrostatic spray coating and baking.

In electrostatic spray coating operations, it is necessary that the workpiece fixture establish and maintain electrical continuity between the suspended articles and an overhead carrier or conveyor, in order that the articles to be coated can be electrically charged so as to attract the oppositely charged coating material. It is therefore important that electrical continuity between each article-engaging hook and the frame of the workpiece fixture be maintained as a good, low resistance electrical contact. The accumulation of non-conductive or high resistance coating material at the interfacing electrical contacting surfaces between each article-engaging hook and the frame must be prevented. Unfortunately, repetitive use of the workpiece fixture results in a build-up of coating material between these interfacing electrical contacting surfaces with the eventual loss of electrical continuity with the suspended articles. Eventually, this build-up must be removed from the workpiece fixture, usually by immersing and soaking the fixture in a solvent bath for a prolonged period of time. The need for frequent cleaning demands either prolonged downtime of the coating apparatus or a large inventory of workpiece fixtures, both of which add materially to the cost of the coating operation.

One known workpiece fixture is disclosed in U.S. Pat. No. 4,217,853. A disadvantage with this known workpiece fixture is the difficulty of removing the article-engaging hooks from the main frame of the fixture, especially when encrusted with a build-up of coating material. This encrustation renders it difficult, if not impossible, to substitute article-engaging hooks of a different size or to replace those which become broken. In addition, once the main frame has been encrusted with coating material, it is relatively difficult during replacement of the article-engaging hooks to insure good, low resistance electrical continuity between the interfacing electrical contacting surfaces. Another disadvantage is that this workpiece fixture is relatively expensive to construct because it requires a substantial quantity of metal and numerous manufacturing operations.

SUMMARY OF THE INVENTION

It is broadly an object of the present invention to provide an apparatus and workpiece fixture for electrostatic coating which overcomes or avoids one or more of the foregoing disadvantages resulting from the use of the above-mentioned known workpiece fixtures, and which fulfills the requirements of such a workpiece fixture for use in an apparatus for electrostatic coating of electrically charged material. Specifically, it is within the contemplation of one aspect of the present invention to provide such an apparatus for electrostatic spray coating operations employing a workpiece fixture which may be repetitively used over a comparatively long period of time before required cleaning, thereby greatly reducing the number of such fixtures required to sustain continuous coating operations.

Another object of the present invention is to provide an apparatus for electrostatic coating operations employing a workpiece fixture which features detachable and interchangeable article-engaging hooks which may be removed by a simple withdrawal motion and then reinserted by a simple reversal of the procedure.

Another object of the present invention is to provide an apparatus for electrostatic coating operations employing a workpiece fixture including interchangeable article-engaging hooks that insure electrical continuity at the interfacing electrical contacting surfaces regardless of the degree of encrustation of the fixture with multiple layers of coating material.

Another object of the present invention is to provide an apparatus for electrostatic coating operations employing a workpiece fixture wherein the article-engaging hooks are constructed for removing foreign coating material from the interfacing electrical contacting surfaces upon removal and reinsertion thereof.

Another object of the present invention is to provide an apparatus for electrostatic coating operations employing a workpiece fixture which is inexpensive to manufacture so that it may be disposed of rather than requiring cleaning for removal of accumulated coating material.

Another object of the present invention is to provide an apparatus for electrostatic coating operations employing a workpiece fixture which may be constructed and arranged in a variety of configurations for supporting various articles of different size and shapes.

In accordance with one embodiment of the present invention there is disclosed a fixture for supporting a workpiece during coating operations. The fixture is constructed of a first conductive frame having at least one recessed contact surface thereon, and a first conductive workpiece support having a workpiece retaining end and a resilient contact end. The resilient contact end is constructed of a U-shaped member removably engaging the conductive frame and having a portion frictionally contacting the contact surface upon relative movement between the contact surface and the U-shaped member, whereby foreign material on the contact surface is removed to provide electrical continuity between the workpiece support and the frame.

In accordance with another embodiment of the present invention there is disclosed a fixture for supporting a workpiece during a coating operation. The fixture is constructed of a first conductive rod having a pair of opposed notches defining at least one contact surface, and a first conductive workpiece support having a workpiece retaining end and a spring biased contact end. The spring biased contact end is constructed of a U-shaped member removably engaging the rod within the notches and having a portion functionally contacting the contact surface upon relative movement between the contact surface and the U-shaped member, whereby foreign material on the contact surface is removed to provide electrical continuity between the workpiece support and the rod.

In accordance with another embodiment of the present invention, there is disclosed an apparatus for electrostatic spray coating of a workpiece supported on a fixture. The apparatus is constructed of a fixture including a conductive frame having at least one recessed contact surface thereon, and a conductive workpiece support having a workpiece retaining end and a resilient contact end. The resilient contact end is constructed of a U-shaped member removably engaging the conductive frame and having a portion frictionally contacting the contact surface upon relative movement between the contact surface and the U-shaped member, whereby foreign material on the contact surface is removed to provide electrical continuity between the workpiece support and the frame. Applying means are provided for applying an electrostatic potential to the workpiece supported on the retaining end of the workpiece support. In addition, spraying means are provided for spraying a coating material onto the workpiece to be coated.

BRIEF DESCRIPTION OF THE DRAWINGS

The above description, as well as further objects, features and advantages of the present invention, will be more fully understood by reference to the following detailed description of a presently preferred but nonetheless illustrative apparatus and workpiece. fixture for electrostatic spray coating operations in accordance with the present invention when taken in conjunction with the accompanying drawings, wherein:

FIG. 1 is a front view showing an apparatus for electrostatic spray coating operations including a workpiece fixture for supporting a plurality of articles upon article-engaging hooks, such fixture being constructed and arranged in accordance with the principles of the present invention;

FIG. 2 is a cross-sectional view taken along Line 2—2 of FIG. 1 showing a portion of the workpiece fixture having a plurality of opposed notches of V-shape defining interfacing electrical contacting surfaces for engaging a portion of the article-engaging hooks to maintain electrical continuity therebetween;

DESCRIPTION OF THE PREFERRED EMBODIMENT

Figure 3:
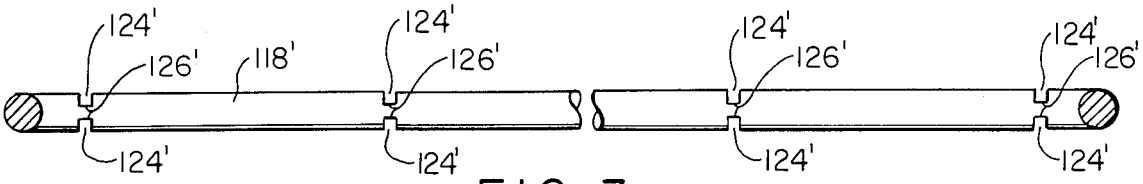
FIG. 3 is an alternate embodiment of that portion of the fixture shown in FIG. 2 wherein the notches are illustrated as rectangular in cross-section.

Turning now to FIG. 1, wherein like reference numerals represent like elements, there is shown an apparatus generally designated by reference numeral 100 for electrostatic spray coating of liquid or dry charged particles onto a plurality of articles at a coating station. The apparatus 100 includes an electrostatic spray gun 102, a workpiece fixture 104, an overhead carrier 106, and a power supply 108 for providing a high-voltage electrostatic charge.

In accordance with one embodiment, the workpiece fixture 104 is constructed of an electrically conductive rod 110 configured to include a triangular-shaped frame 112 and a vertically extending member 114 terminated by a U-shaped hook 116. The frame 112 is constructed of a horizontal member 118 and a pair of upper angularly arranged members 120, 122. As more clearly shown in FIG. 2, the lower member 118 is provided with a plurality of spaced-apart V-shaped opposed notches 124, each defining a recessed contact surface 126. The respective opposed notches 124 are arranged in parallel planes on opposing sides of the lower member 118 and have longitudinal axes in a vertical orientation. However, the notches 124 may be arranged so that their longitudinal axes are in a horizontal orientation if desired.

Figure 4A:
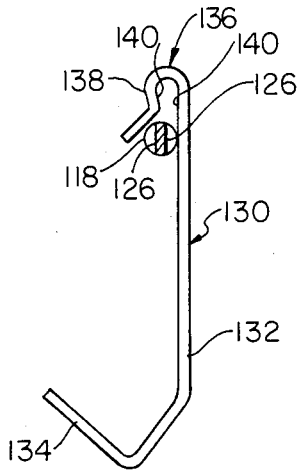
FIGS. 4*a*–4*c* show the installation of an article-engaging hook upon the main frame of the workpiece fixture wherein foreign material on the interfacing electrical contacting surfaces are removed by a portion of the hook to insure electrical continuity therebetween.
Figure 4B:
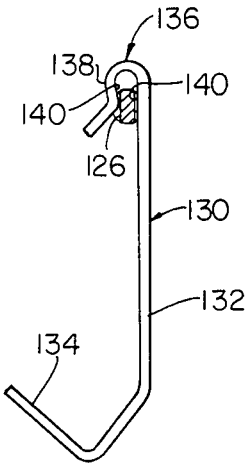
Figure 4C:
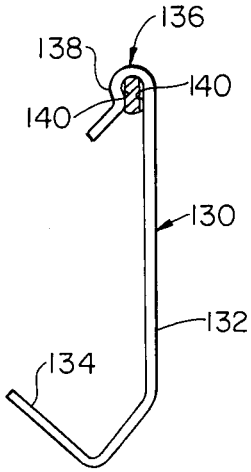

In accordance with another embodiment, as shown in FIG. 3, the lower member 118' is provided with a plurality of notches 124' having a rectangular cross-section to define contact surfaces 126'. The notches 124, 124' are formed recessed into the circumferential portion of the lower members 118, 118' to provide the recessed contact surfaces 126, 126' having an effective diameter less than the diameter of the lower members. Although the notches 124, 124' have been described as being either V-shaped or rectangular-shaped, other configurations and spacial arrangements may be employed. Workpieces or articles 128 to be coated are supported by a plurality of removable electrically conductive workpiece supports or article-engaging hooks 130. As shown in FIGS. 4*a*–4*c*, the hooks 130 are constructed of a resilient electrically conductive wire 132 having a workpiece retaining end 134 and a resilient contact end 136 constructed of a U-shaped member 138. The U-shaped member 138 is provided with opposing interior contact surfaces 140 spaced apart a distance slightly smaller than the spaced-apart distance of the contact surfaces 126 defined by the opposing notches 124.

The installation of the hooks 130 into electrical continuity with the frame 112 of the fixture 104 will now be described. As shown in FIGS. 4*a*–4*c*, a hook 130 is positioned such that the opening of the U-shaped member 138 is overlying the lower member 118 and in registration with a pair of opposed notches 124. By pulling the hook 130 in a downward direction, the contact surfaces 140 of the U-shaped member 138 frictionally contact the contact surfaces 126 of the notches 124. This frictional engagement is enhanced by the fact that the opening of the U-shaped member 138 is dimensioned slightly smaller than the effective crosssectional diameter of the contact surfaces 126. As the hook 130 is further urged downward, the relative movement between the contact surfaces 126 defined by the notches 124 and the contact surfaces 140 defined by the U-shaped member 138 removes any foreign material, e.g., paint, from the contact surfaces to insure electrical continuity between the hook and the lower member 118.

Thus, by the simple installation of a hook 130 onto the lower member 118, the contacting surfaces 126, 140 are effectively scraped clean of any foreign material that may have been deposited during the electrostatic spray coating operation. As the U-shaped member 138 is of a resilient nature, a firm compression between the contact surfaces 126 and contact surfaces 140 is achieved to prevent coating material from being deposited therebetween and enhancing the maintaining of electrical continuity. In the event that coating material should cover a portion of the contact surfaces 126, 140, the simple step of removing the affected hook 130 and its reinstallation, will remove the coating material without the need of having to strip the entire frame 112 or the hook 130 of the encrusted coating material. The ability of the hooks 130 to self-clean the contact surfaces 126, 140 during installation is a great benefit, whether the need arises to replace the hooks with ones of different size or those that should become broken. In addition, the notches 126 are effective to locate the hooks 130 and to prevent their inadvertent lateral movement along the lower member 118, whereby the articles 128 to be coated would interfere with one another.

Briefly in accordance with the apparatus 10 of the present invention, a plurality of hooks 130 are engaged upon the lower member 118 of the frame 112, being positioned within a respective pair of opposing notches 124. Articles 128 to be coated in the electrostatic coat spraying operation are supported by the retaining end 134 of each hook 130. The fixture 104 is supported on a carrier 106 by means of the hook 116. An electrostatic potential is applied to the articles 128 by means of the power supply 108 being connected to the carrier 106. Atomized paint 144 or other such coating material, is supplied by the spray gun 102 and attracted to the articles 128 by the electrostatic potential created between the paint and the articles. Due to the frictional engagement of the contact surfaces 126 of the notches 124 with the contact surfaces 140 of the hooks 130, paint is prevented from affecting the electrical continuity therebetween. The carrier 106 may thereafter advance the fixture 104 and coated articles 128 through a baking oven in which the applied coating is heat treated, hardened and dried. At such time, the articles 128 may be removed from the hooks 130, uncoated articles provided thereon and the electrostatic spray coating operation repeated.

Figure 5:
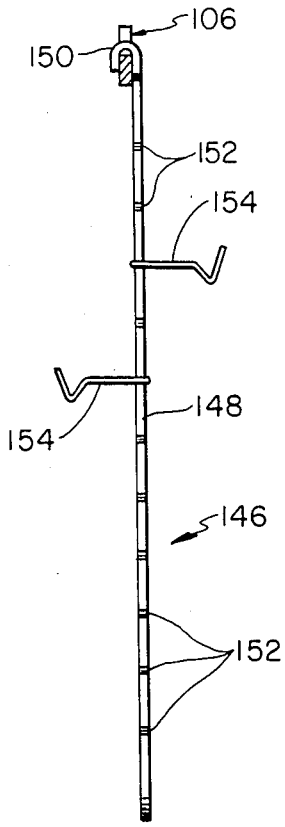
FIG. 5 shows another embodiment of the workpiece fixture disclosed in FIG. 1 and having a plurality of article-engaging hooks arranged horizontally for suspending articles therefrom.

Referring now to FIG. 5, there is shown the construction of a workpiece fixture 146 in accordance with another embodiment of the present invention. The fixture 146 is constructed of an electrically conductive longitudinally extending rod 148 having a U-shaped hook 150 and a plurality of pairs of opposed notches 152 horizontally arranged along the rod. In this regard, articles to be coated may be supported by hooks 154 extending horizontally from the workpiece fixture 146 as opposed to vertically in accordance with the embodiment shown in FIG. 1. The installation and removal of the hooks 154 to provide electrical continuity with the rod 148 is achieved in the same manner as previously described with regard to hooks 130 in FIGS. **4*a*–4*c***.

Figure 6:
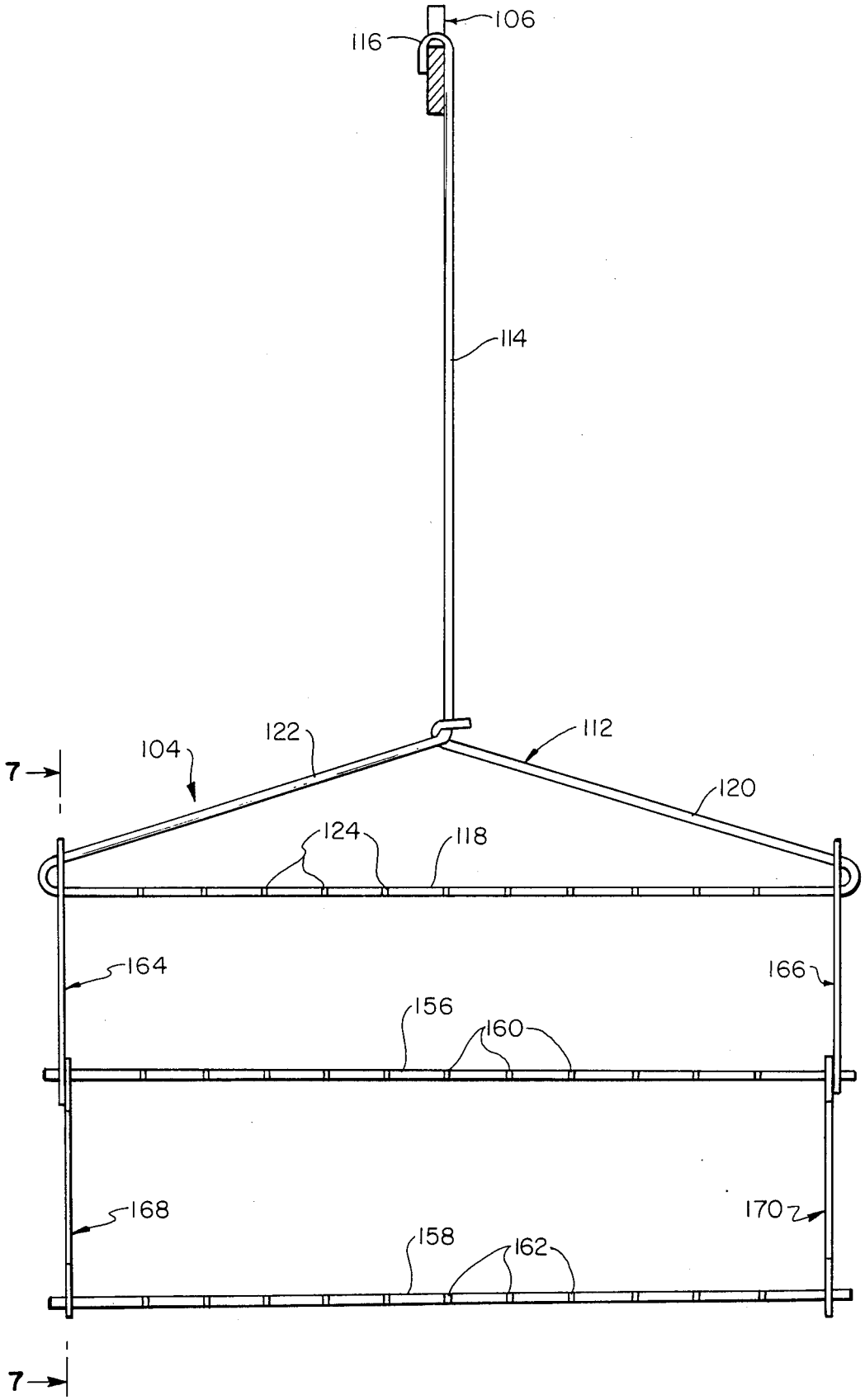
FIG. 6 is a front view showing the workpiece fixture of the present invention as illustrated in FIG. 1 employing tiers of conductive frame members secured to the main frame by means of side suspending brackets which maintain electrical continuity therebetween.

Turning now to FIG. 6, the workpiece fixture 104 can form the base for a tiered arrangement of horizontal rows of article supporting rod members. As shown, two electrically conductive rod members 156, 158 are provided with a plurality of pairs of opposed notches 160, 162, respectively, in the manner as previously described. The rod members 156, 158 are maintained in spaced-apart parallel relationship and in electrical continuity with the fixture 104 by means of electrically conductive side suspending brackets 164, 166, 168, 170. The brackets 164, 166, 168, 170 are constructed to facilitate the assembly and disassembly of the fixture 104 and rod members 156, 158 while maintaining electrical continuity therebetween. It is to be understood that although only two rod members 156, 158 have been disclosed, any number of such rod members may be employed to provide a tiered workpiece fixture. Articles to be coated may be supported by hooks (not shown) which are in electrical engagement with the lower member 118 or rod members 156, 158 in the manner as previously described with respect to FIGS. **4*a*–4*c***.

Figure 8:
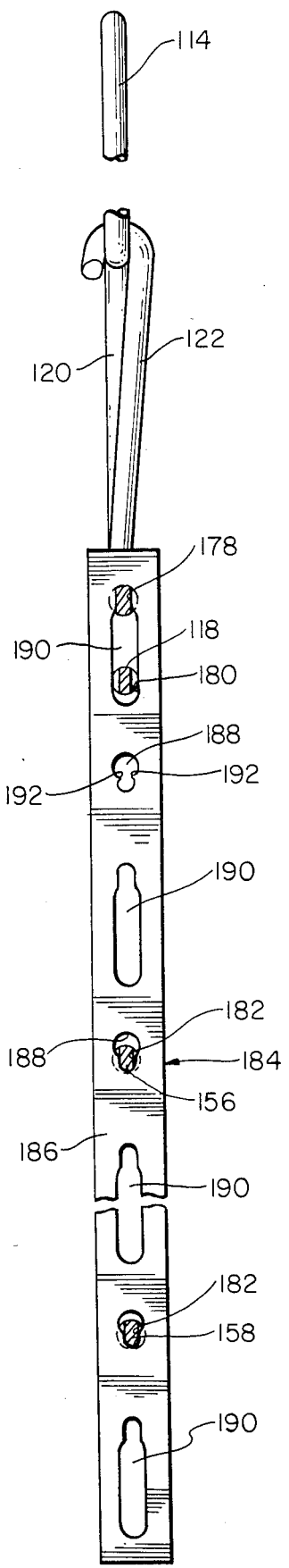
FIG. 8 is a side view of the workpiece fixture in accordance with the present invention showing the construction of an alternate embodiment of the side suspending bracket and having keyhole-shaped openings for engaging the conductive frame members and main frame of the workpiece fixture.
Figure 7:
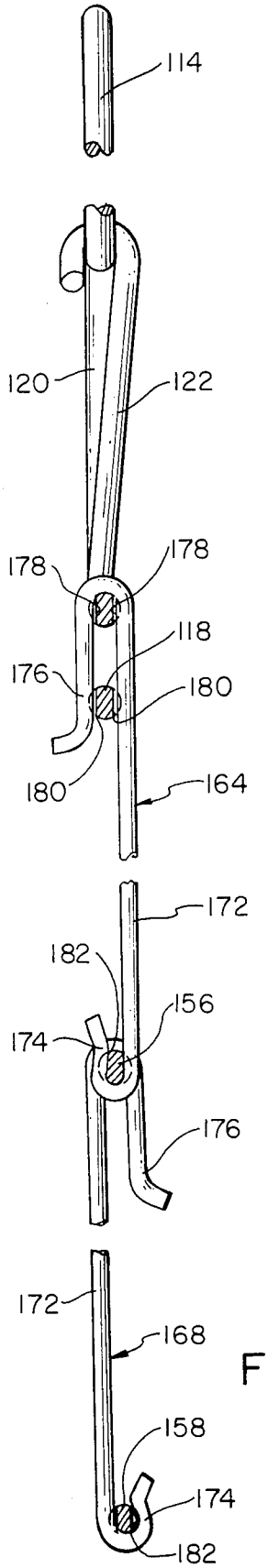
FIG. 7 is a sectional view taken along Line 7—7 of FIG. 6 showing the construction and arrangement of the side suspending brackets in accordance with one embodiment of the present invention.

Two embodiments showing the construction of the brackets 164, 166, 168, 170 are shown in FIGS. 7 and 8. Referring to FIG. 7, each of the brackets 164, 166, 168, 170 are of similar construction from a longitudinally extending rod 172 having a resilient U-shaped member 174 at one end thereof and an elongated resilient U-shaped member 176 at the other end thereof. In assembling the fixture 104 as shown in accordance with the embodiment of FIG. 6, the elongated U-shaped member 176 of bracket 164 is engaged by a pair of vertically aligned notches 178, 180 provided at the common joined ends of lower member 118 and angular member 122, as more clearly shown in FIG. 1. The notches 178, 180 provide for the proper location of the bracket 164, in addition to insuring electrical continuity therebetween. In a similar manner, rod member 156 is secured in electrical continuity to U-shaped member 174 at notches 182 as shown in FIG. 7. Bracket 166 is secured to the fixture 104 and to rod member 156 to maintain electrical continuity therebetween in a similar manner. Likewise, brackets 168, 170 secure rod members 156, 158 together in electrical continuity in the same manner. It should now be apparent that the resilient U-shaped members 174, 176 are adapted for engagement with the notches 178, 180, 182 in a similar manner as the hooks 130 engage the notches 124, 124'.

Turning now to the embodiment disclosed in FIG. 8, a single bracket 184 may be used to replace the pairs of brackets 164, 166, and 168, 170. The bracket 184 is constructed of a longitudinally extending flat electrically conductive strip 186. Positioned along the strip are alternating keyhole-shaped openings 188 and elongated keyhole-shaped openings 190. The bracket 184 electrically interconnects the rod members 156, 158 and lower member 118 of the fixture 104 in the same manner as brackets 164, 166, 168, 170. In this regard, notches 182 of the rod members 156, 158 engage the keyhole-shaped openings 188 in order to maintain electrical continuity therebetween. The keyhole-shaped openings are further provided with a pair of dimples 192 which frictionally engage the rod members 156, 158 thereby enhancing their securement and the maintaining of electrical continuity. The workpiece fixture 104 is secured to the bracket 184 by inserting the common joined ends of the lower member 118 and angular member 122 through the elongated keyhole-shaped opening 190 and in registration with the notches 178, 180. Upon urging the bracket 184 downward about the fixture 104, the constricted upper portion of the elongated keyhole-shaped opening 190 engages the opposed notches 178 of the angular member 122, thereby insuring electrical continuity. From the foregoing, it is to be understood that the bracket 184 may be of any convenient length, so that any number of rod members 156, 158 may be arranged in tiered relationship with the fixture 104. In this regard, the bracket 184 may be conveniently stamped with the keyhole-shaped openings 188, 190 in an inexpensive manner, such that the bracket 184 may be disposed of as opposed to being stripped of coated material when necessary.

Although the invention herein has been described with reference to particular embodiments it is to be understood that these embodiments are merely illustrative of the principals and application of the present invention. For example, although the present invention has been described as having utility in electrostatic spray coating operations, other coating methods may be employed where there is the need to maintain electrical continuity with the article to be coated. It is therefore to be understood that numerous modifications may be made in the illustrative embodiments and that other arrangements may be devised without departing from the spirit and scope of the present invention as defined by the appended claims.

What is claimed is:

1. A fixture for supporting a workpiece during a coating operation, said fixture comprising a first conductive frame having at least one recessed contact surface thereon, a first conductive workpiece support having a workpiece retaining end and a resilient contact end, said resilient contact end constructed of a U-shaped member removably engaging said conductive frame and having a portion frictionally contacting said contact surface upon relative movement between said contact surface and said U-shaped member, whereby foreign material on said contact surface is removed to provide electrical continuity between said workpiece support and said frame, a second conductive frame having at least one recessed contact surface providing electrical continuity between a second conductive workpiece support and said second conductive frame, and a pair of brackets for removably attaching in electrical continuity said second conductive frame in spaced-apart relationship with said first conductive frame, each said bracket comprises a longitudinally extending strip having a plurality of keyhole-shaped openings therein, said keyhole-shaped openings removably engaging a respective portion of said first and second conductive frames.

2. The fixture of claim 1 wherein said recessed contact surface is defined by one of a pair of opposed notches arranged along said conductive frame.

3. The fixture of claim 1 wherein said first and second conductive frames include recessed contact surfaces provided thereon and arranged for engagement with said brackets.

4. A fixture for supporting a workpiece during a coating operation, said fixture comprising a first conductive rod having a pair of opposed notches defining at least one contact surface, a first conductive workpiece support having a workpiece retaining end and a spring biased contact end, said spring biased contact end constructed of a U-shaped member removably engaging said rod within said notches and having a portion frictionally contacting said contact surface upon relative movement between said contact surface and said U-shaped member, whereby foreign material on said contact surface is removed to provide electrical continuity between said first conductive workpiece support and said rod, a second conductive rod having at least one recessed contact surface providing electrical continuity between a second workpiece support and said second conductive rod, and a pair of longitudinally extending strips for removably attaching in electrical continuity said second conductive rod in spaced-apart relationship with said first conductive rod, each of said strips having a plurality of keyhole-shaped openings removably engaging a respective portion of said first and second conductive rods.

5. The fixture of claim 4 wherein said notches have a V-shaped cross-section.

6. The fixture of claim 4 wherein said notches have a rectangular cross-section.

7. The fixture of claim 4 wherein said notches have a longitudinal axis arranged vertically.

8. The fixture of claim 4 wherein said notches have a longitudinal axis arranged horizontally.

9. The fixture of claim 4 wherein said notches are arranged in parallel planes on opposing sides of said rod.

10. The fixture of claim 4 wherein at least one of said keyhole-shaped openings includes a pair of opposed dimples for frictionally engaging one of said first and second conductive rods at said recessed contact surface.

11. The fixture of claim 4 wherein said first conductive rod is triangular in shape.

12. The fixture of claim 4 wherein the effective diameter of the open area of said U-shaped member is smaller than the cross-sectional diameter of said first conductive rod.

13. An apparatus for electrostatic spray coating of a workpiece supported on a fixture, said apparatus comprising a fixture including a first conductive frame having at least one recessed contact surface thereon, and a first conductive workpiece support having a workpiece retaining end and a resilient contact end, said resilient contact end constructed of a U-shaped member removably engaging said conductive frame and having a portion frictionally contacting said contact surface upon relative movement between said contact surface and said U-shaped member, whereby foreign material on said contact surface is removed to provide electrical continuity between said first conductive workpiece support and said frame; a second conductive frame having at least one recessed contact surface providing electrical continuity between a second conductive workpiece support and said second conductive frame, and a pair of brackets for removably attaching in electrical continuity said second conductive frame in spaced-apart relationship with said first conductive frame, each said bracket comprises a longitudinally extending strip having a plurality of keyhole-shaped openings therein, said keyhole-shaped openings removably engaging a respective portion of said first and second conductive frames; applying means for applying an electrostatic potential to said workpiece supported on said retaining end of said workpiece supports; and spraying means for spraying a coating material onto said workpiece to be coated.

14. The apparatus of claim 13 further including means for transporting said fixture to and from the location of said spraying means.

15. The apparatus of claim 14 wherein said recessed contact surface is defined by one of a pair of opposed notches arranged along said conductive frame.

16. A fixture for supporting a workpiece during an electrocoating operation for the depositing of substantially electrically nonconductive material, said fixture comprising an electrically conductive rod having at least one pair of opposed vertical contact surfaces recessed therein, the distance between said contact surfaces being less than the diameter of said rod, and an electrically conductive workpiece support having a workpiece retaining end and a resilient contact end, said resilient contact end constructed of a U-shaped member having spaced apart front and rear engaging portions, the distance between said front and rear engaging portions being less than the distance between said contact surfaces, said front and rear engaging portions frictionally engaging said contact surfaces upon relative movement between said rod and said workpiece support, whereby said material deposited during said electrocoating operation on said contact surfaces is removed to provide electrical continuity between said rod and said workpiece support.

17. A fixture for supporting a workpiece during a coating operation, said fixture comprising a first conductive frame, a second conductive frame, a conductive workpiece support having a workpiece retaining end and a contact end, said contact end engaging one of said conductive frames to provide electrical continuity therewith, and a pair of brackets for removably attaching in electrical continuity said second conductive frame in spaced-apart relationship with said first conductive frame, each said bracket comprises a longitudinally extending strip having a plurality of keyhole-shaped openings removably engaging a respective portion of said first and second conductive frames.

* * * * *